United States Patent [19]

Perr et al.

[11] Patent Number: 4,962,743

[45] Date of Patent: Oct. 16, 1990

[54] INJECTION RATE CONTROL CAM

[75] Inventors: Julius P. Perr, Columbus, Ind.; Eric Liang, Peoria, Ill.; Robert C. Yu; Amarjit S. Ghuman, both of Columbus, Ind.

[73] Assignee: Cummins Engine Company, Inc., Columbus, Ind.

[21] Appl. No.: 362,266

[22] Filed: Jun. 6, 1989

[51] Int. Cl.[5] ..... F02M 39/00

[52] U.S. Cl. ..... 123/496; 123/501; 123/300; 123/508

[58] Field of Search ..... 123/496, 508, 507, 500, 123/501, 249, 300; 239/88–96

[56] References Cited

U.S. PATENT DOCUMENTS

| | | | |
|---|---|---|---|
| 1,865,099 | 6/1932 | Groff | 123/501 |
| 2,960,079 | 11/1960 | Monnot | 123/299 |
| 3,125,076 | 3/1964 | Mullaney | 123/508 |
| 3,544,008 | 12/1970 | Reiners et al. . | |
| 3,698,373 | 10/1972 | Nagasawa | 123/300 |
| 3,827,419 | 8/1974 | Isomura | 123/300 |
| 3,965,875 | 6/1976 | Perr . | |
| 4,335,686 | 6/1982 | Herdin et al. . | |
| 4,467,772 | 8/1984 | Williamson | 123/501 |

FOREIGN PATENT DOCUMENTS

| | | | |
|---|---|---|---|
| 957913 | 2/1950 | France | 123/496 |
| 317320 | 8/1928 | United Kingdom | 123/508 |
| 277678 | 4/1929 | United Kingdom . | |
| 318889 | 8/1930 | United Kingdom . | |

*Primary Examiner*—Carl S. Miller

*Attorney, Agent, or Firm*—Sixbey, Friedman, Leedom & Ferugson

[57] ABSTRACT

A cam for controlling the injection rate of fuel in a fuel injection system having a four part cam profile is disclosed. The first 120° is the plunger advancement segment. The next 80° is the advanced dwell segment. The next 100° is the plunger retraction segment and the last 60° is the retracted dwell segment. The plunger advancement segment is divided into three subsegments: pre-injection stroke, injection stroke, and overtravel stroke. The pre-injection subsegment achieves minimum velocity and acceleration at the start of injection. In the injection subsegment, the cam follower acceleration is achieved as rapidly as can Hertz stress permits to increase the injection pressure and to achieve the maximum injection rate. The overtravel subsegment achieves a sharp and clean end of injection. Preferably, this cam causes injection of less than 20 $mm^3$ of fuel per stroke during the first ten cam angle degrees of cam rotation. The injection pressure and the amount of injection are reduced at the beginning of injection, timing is advanced, and optimal control over the rate of fuel injection is provided.

23 Claims, 4 Drawing Sheets

INJECTION RATE CONTROL CAM

TECHNICAL FIELD

The present invention relates to a cam for use with a unit fuel injector system to control the movement of the injector plunger to effect a desired rate of fuel injection.

BACKGROUND OF THE INVENTION

Unit fuel injectors operated by cams, have long been used in compression ignition internal combustion engines for their accuracy and reliability. A unit injector typically includes an injector body having a nozzle at one end and a cam driven injector plunger mounted for reciprocal movement within the injector body. When the cam causes the plunger to reach its retracted position, a controlled amount of fuel is metered into the injector such that upon plunger advancement the metered quantity of fuel is forced through orifices in the injector nozzle into a combustion chamber of the engine. To achieve optimal engine operation, the fuel must be injected at very high pressure to achieve the maximum possible atomization of the injected fuel. In addition, the interval of injection needs to be carefully timed during each cycle of injector operation in dependance upon the movement of the corresponding engine piston. Fuel system designers have found that both high pressure and carefully timed operation can normally be achieved most easily by mounting the injector cam on the engine camshaft which rotates in a fixed relationship with the engine crankshaft. An injector drive train extending between the injector cam and injector plunger is adapted to convert cam rotation into reciprocating movement of the injector plunger. A typical type of cam operated unit injector is disclosed in U.S. Pat. No. 3,544,008 assigned to the same assignee as the subject invention.

Many unit injector systems modify the fuel injector or injector drive train to vary the rate of fuel injection during each injection interval in order to achieve still further improvement in overall engine operation. One such system is disclosed in U.S. Pat. No. 3,965,875 to Perr, one of the co-inventors of this invention. The '875 patent discloses a fuel injection system providing a slower rate of fuel injection during the initial phase of fuel injection. In the '875 system, an injection rate control device is connected in line with a conventional injector train and includes an auxiliary spring having a lower spring rate than that of the remaining portion of the injection train to slow the plunger advance and the resulting initial rate of fuel injection during the initial portion of each injection interval. However, the '875 patent does not specifically discuss the concept of a cam profile that creates carefully modulated injector plunger velocities.

U.K. Patent No. 318,889 discloses the concept of an injector cam profile having successive sections of differing shape to control the rate of fuel delivery at slow engine speeds. As engine speed decreases, the injection arc on the cam actuating the injector is adjusted to a steeper section of the fuel cam, thereby delaying the commencement of injection. This approach maintains sufficient injection velocity and acceptable atomization at lower engine speeds, but does not address the need for an idealized schedule of fuel flow rates throughout each injection interval at both high and low engine speeds.

Although the systems disclosed in the above references create different stages of injection, improvement and further refinement of the staged injection cycle is still desirable. For example, neither of the cams disclosed in the above references are necessarily able to adequately and simultaneously control engine noise, nitric oxide emissions, and unburned hydrocarbons.

Herdin et al. U.S. Pat. No. 4,355,686 and U.K. Patent No. 277,678 disclose other types of known injector cams having shapes designed to achieve specific functional results. These patents fail to disclose an injector cam profile which improves engine operation throughout the entire operating range of the engine. There is a need, unfulfilled in the prior art, for an injector cam having a profile that improves engine operation and the injection characteristics throughout the entire operating range of the engine, at both high and low operating speeds.

SUMMARY OF THE INVENTION

It is an object of the present invention to overcome the deficiencies of the prior art by providing a cam profile for an injection cam that provides more nearly optimal control over the rate of fuel injection in a fuel supply system for an internal combustion engine.

It is another object of the present invention to provide an improved injector cam having a profile which is capable of controlling the amount of injected fuel during the first portion of each injection period of each injection cycle to thereby reduce engine noise, nitric oxide emissions, and the amount of unburned hydrocarbons.

It is another object of the present invention to provide an improved cam operated unit injection system using a cam whose profile includes a plunger advancement segment having successive subsegments designed to optimize certain specified injection performance characteristics as each of the successive subsegments engages the injector drive train.

It is another object of the present invention to provide an improved cam operated unit injection system having an optimally varied rate of fuel flow throughout the plunger advancement segment of each cycle of operation, including a cam whose profile includes an injector plunger advancement segment having successive subsegments designed to optimize successively the injector functions of pre-injection, injection, and overtravel.

Yet another object of the present invention is to provide a cam having a profile of the type disclosed wherein the pre-injection subsegment extends over approximately one-third of the advancement segment and is shaped to cause the injector plunger velocity to be relatively low thereby to cause injection of no more than 10 percent (and preferably no more than five percent) of the maximum possible quantity of fuel which the injector is designed to inject during each cycle under rated engine conditions.

Still another object of the present invention is to provide a cam having a profile of the type disclosed wherein the second approximately one-third of the advancement segment is shaped to cause maximum possible plunger velocity consistent with cam hertz stress limitations thereby causing substantially all of the metered quantity of fuel to be injected and wherein the injection subsegment is shaped to cause plunger velocity to increase during the initial stage and to decrease during the final stage of plunger control by the injection subsegment, thereby causing maximum plunger velocity intermediate the initial and final stage of the injection subsegment, and wherein the injection subsegment and pre-injection subsegment are shaped to cause respective average fuel flow rates having a ratio ranging between 2.5 and 7.

It is a further object of the present invention to provide a cam having an injector plunger advancement segment including a final subsegment extending over approximately one-third of the final arcuate portion of the plunger advancement segment shaped to cause the injector plunger to engage a plunger stop surface adjacent the injector nozzle to close the injector nozzle and to cause the injector plunger to be advanced to cause overtravel of the injector plunger and elastic deformation of the injector body to insure a sharp clean cut off of fuel flow.

The above objects are achieved in accordance with the present invention by a cam having a four part profile including (1) a plunger advancement segment extending for approximately 120° around the cam for causing injector plunger advancement, (2) an advanced dwell segment extending over approximately 80° for maintaining the injector plunger in its advanced position, (3) an injector plunger retraction segment extending over approximately 100° of cam circumference to cause plunger retraction and (4) a retracted dwell segment extending over approximately 60° of the cam circumference for maintaining the injector plunger in its retracted position. The plunger advancement segment is divided into three arcuate subsegments including (1) a pre-injection subsegment shaped to achieve minimum velocity and acceleration at the start of injection to slow the injection rate, (2) an injection subsegment shaped to achieve injector plunger velocities and acceleration as rapidly as cam hertz stress permits to increase the injection pressure and to achieve the maximum injection flow rate, and (3) an overtravel segment which achieves a sharp and clean end of injection. Preferably, the pre-injection subsegment will cause no more than 20 cubic millimeters of fuel injection during the first ten crank degrees of cam rotation even during maximum fuel quantity injection at rated engine conditions.

Various additional advantages and features of novelty which characterize the invention are further pointed out in the claims that follow. However, for a better understanding of the invention and its advantages, references should be made to the accompanying drawings and descriptive matter which illustrate and describe preferred embodiments of the invention.

DETAILED DESCRIPTION OF THE PREFERRED EMBODIMENTS

Figure 1:
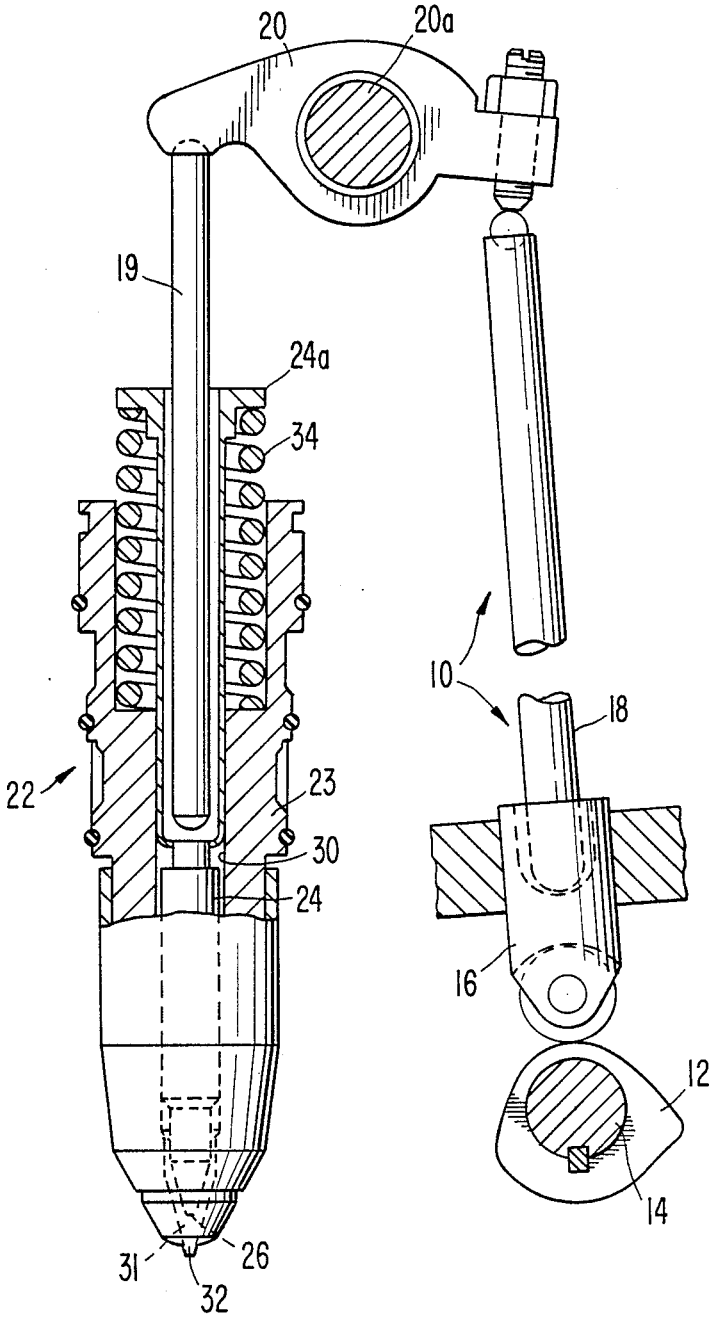
FIG. 1 is a cross-sectional view of an injection train having a cam designed according to the present invention.

As shown generally in FIG. 1, the present invention may be employed in a cam driven unit injector system suitable for use in compression ignition internal combustion engines. In particular, each injector of such a system is actuated by means of an injector drive train 10 connected at one end to a unit injector 22 and at the other end to a rotating cam 12 mounted on and keyed to rotatable cam shaft 14. The fuel injector itself may be any type of unit fuel injector, such as those described in the assignee's U.S. Pat. Nos. 3,146,949 and 3,351,288. As shown in FIG. 1, the injector 22 includes a plunger 24 mounted for reciprocating movement in a body 23 for injecting fuel through a nozzle 32 threaded onto the lower end of the body 23. A return spring 34 disposed between the body 23 and a flange **24*a* on the top of the plunger 24 biases the plunger toward its retracted position illustrated in FIG. 1**.

For driving plunger 24 from its retracted position to its advanced position (during which fuel is injected into the engine) the injector drive train 10 includes the following elements: a cam follower 16 riding on cam 12, a connecting rod 18 connected to the cam follower 16, a rocker arm 20 pivoted on a shaft **20*a*, and a push rod 19 connected at one end to the rocker arm 20 and at the other end to plunger 24. In the retracted position plunger 24 forms an injection chamber 31 into which fuel may be metered by pressure/time principles, as explained in U.S. Pat. Nos. 3,351,288 and 3,544,008 in which the amount of fuel metered is varied within a given amount of time by varying the supply line (common rail) pressure, or other known metering procedures. The amount of fuel metered determines the amount of fuel injected when plunger 24 is advanced and varies from a minimal amount for no load, idle condition to a maximum amount at rated engine conditions. An injector nozzle 32 is positioned at the lower end of injector body 23 and contains a plurality of orifices through which fuel is forced into the combustion chamber by plunger 24 upon its advancement. As explained more thoroughly in commonly assigned U.S. Pat. No. 3,965,875, incorporated herein by reference, an injector train 10 such as illustrated in FIG. 1 will have an inherent degree of compliance (as determined by its spring rate) which affects the rate at which plunger 24 can be advanced by cam 12**. As further explained in the '875 patent, fuel injection within a compression ignition engine normally progresses for a period of time, known as a pre-ignition interval, before fuel ignition actually occurs. After the fuel is ignited, which is caused by compression of the atomized fuel and other gases in the cylinder in a diesel engine, injection of fuel continues for an interval which is normally much shorter than the ignition delay interval. That is, ignition occurs before the advancing or injecting stroke of the injector plunger is completed. After the fuel is injected, the plunger tip is seated against a plunger stop adjacent the nozzle to arrest further movement of the plunger despite further forces imparted by the cam. This is the overtravel portion of operation. Because of these special characteristics of unit injectors, it is desirable to vary the rate of fuel injection throughout the entire injection period and it is desirable to inject the bulk of the fuel after fuel ignition has occurred.

It is an important purpose of this invention to achieve a more clearly optimal rate of fuel injection throughout the entire injection interval of the injector cycle, i.e., the interval during which the injector plunger is advancing toward the injector nozzle. In particular, the subject invention achieves the desired rate of fuel injection by providing a cam profile which is designed to slow the initial fuel flow rate of injection during an initial one-third portion of the injection interval and to significantly speed up the fuel flow rate during a second one-third segment of the injection interval. The last one-third segment is devoted to a very quick shut off of fuel flow and overtravel of the injector plunger to insure that the tip of the plunger is held tightly against the nozzle portion of the injector to close the injector nozzle orifices.

Figure 2:
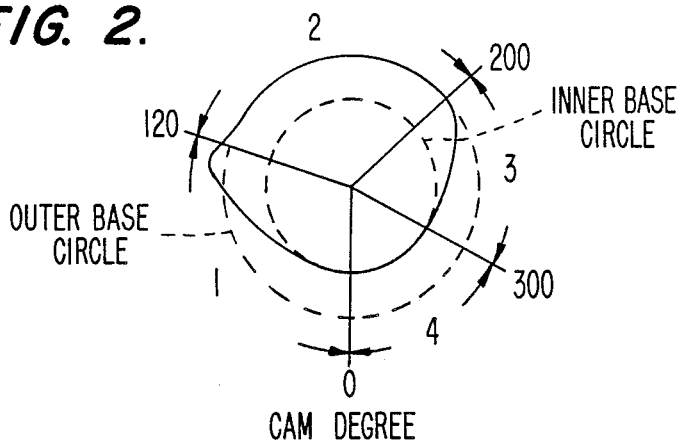
FIG. 2 is a side view of a cam according to the present invention.
Figure 3:
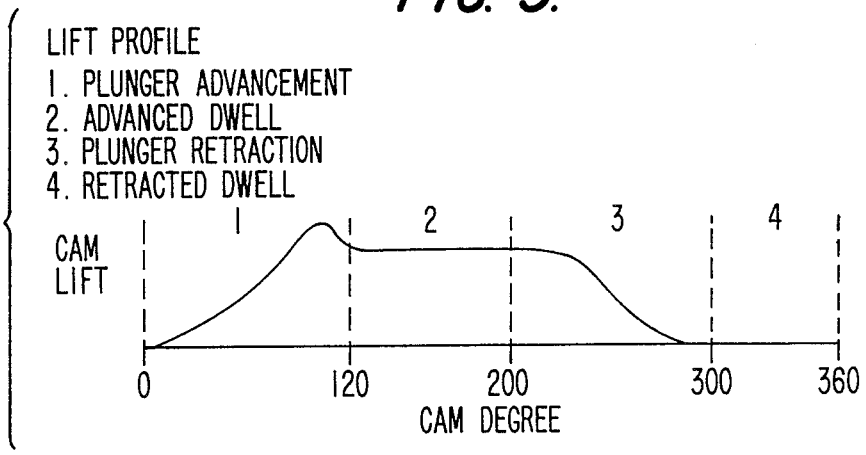
FIG. 3 is a graph illustrating generally the cam lift as a function of cam rotation for the cam of FIG. 2.

The profile of cam 12 designed in accordance with the present invention is shown generally in FIG. 2 in solid line. The circumference of the cam is divided into four successive unequal segments of 120° (segment 1), 80° (segment 2), 100° (segment 3) and 60° (segment 4). Segment 1 controls advance of the injector plunger and is designed in accordance with the subject invention. During segment 1, the injection ramp or plunger advancement segment, the injection plunger moves toward the injector nozzles and causes injection to occur. Segment 1 includes three subsegments, a pre-injection subsegment, an injection subsegment, and an overtravel or crush subsegment, as explained below. Segment 2, which lies on the outer base circle portion of the cam surface is an advanced dwell segment which causes the injector plunger to remain seated against the injector nozzle at the bottom of the injector body. Segment 3 is the retraction ramp or plunger retraction segment and controls the retraction of the injector plunger away from the injector nozzle. The final segment, segment 4, lies on the inner base circle portion of the cam surface. This is a retracted dwell segment in which the cam causes the injector plunger to remain in its retracted position away from the injector nozzles. The four segments have corresponding lift profile characteristics as illustrated in FIG. 3, which graphs the cam lift as a function of the cam degrees of rotation.

Figure 4:
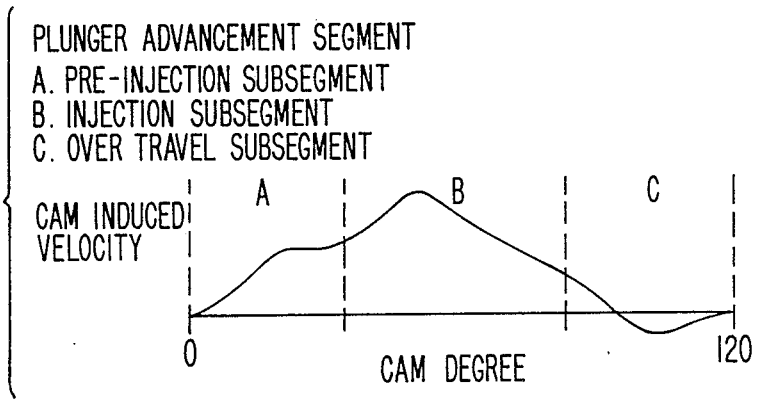
FIG. 4 is a graph illustrating generally the velocity of the injector plunger induced by the cam of FIG. 2 as a function of cam rotation.

FIG. 4 is an approximate plot of the first segment of the cam graphing the cam induced velocity of the plunger against the cam degrees of rotation for the first 120° of cam rotation which make up the plunger advancement segment. As shown, the plunger advancement segment is divided in three subsegments. Subsegment A is the pre-injection stroke subsegment, subsegment B is the injection stroke subsegment, and subsegment C is the overtravel stroke subsegment.

In the pre-injection stroke subsegment, cam lift drives the injector plunger through connecting rod 18 and rocker arm 20. Plunger 24 is translated within injector 22 a distance sufficient to enable plunger tip 26 to reach the fuel column within the injector. The cam induced plunger velocity and the cam induced plunger acceleration are minimized and therefore are low compared to conventional cams. This permits the plunger to squeeze fuel slowly out of the injector nozzle to slow the injection rate and to control the quantity of injected fuel at the beginning of the injection. The average quantity of fuel injected during the pre-injection subsegment ranges from 0.5 to 1 cubic millimeter per cam angle degree of rotation. The pre-injection subsegment encompasses approximately the first 30°–40° or 25–33% of the plunger advancement segment, although 34°–35° is preferred. By causing the plunger velocity to be low, no more than 10%, and preferably no more than 5%, of the maximum possible fuel quantity the injector is designed to inject during each injection cycle at rated engine conditions is injected into the combustion chamber of the engine during the pre-injection subsegment of plunger advancement.

The injection stroke subsegment of the plunger advancement segment occurs immediately after the pre-injection stroke portion. During this portion the cam velocity increases as fast as possible—cam induced plunger acceleration is at a maximum—to rapidly increase the injection pressure within the cam Hertz stress limitations. The average quantity of fuel injected during the injection subsegment of the plunger advancement stage is ranges from 2.5 to 3.5 cubic millimeters per cam angle degree of rotation. The injection subsegment encompasses between 45° and 50° (37–41%) of the 120° plunger advancement segment. Preferably the injection subsegment is 48° in arc length. Substantially all of the remaining fuel in the injection chamber of the injector is injected during the injection subsegment which is shaped to cause the plunger velocity to increase during the initial portion and to decrease during the final portion of plunger control by this subsegment. The maximum plunger velocity and maximum injector flow rate occur intermediate these two portions, preferably before the midpoint of the injection subsegment. The pre-injection and injection subsegments of the plunger advancement segment are shaped to create a ratio of the injection average fuel flow rate to the pre-injection average fuel rate of from 2.5 to 7.

The overtravel stroke subsegment follows the injection stroke subsegment. In the overtravel stroke subsegment, cam 12, through connecting rod 18, and rocker arm 20, pushes plunger 24 even after plunger tip 26 contacts the bottom of injection chamber 31. This slightly compresses the elements of the injection train, causes elastic deformation of the injector body and creates very high pressure in the injection chamber to inject virtually all of the metered fuel out of the injector and into the engine. The overtravel stroke portion provides a transition for the cam and causes the plunger to decelerate from its initial velocity to a zero velocity (and finally a slight negative rebound-velocity) at the end of the overtravel portion which is the end of the plunger advancement segment. This provides a sharp and clean end of injection. The overtravel subsegment encompasses approximately the last 35°–40° (29–33%) of the plunger advancement segment. Preferably this subsegment is approximately 38° in arc length.

Figure 5:
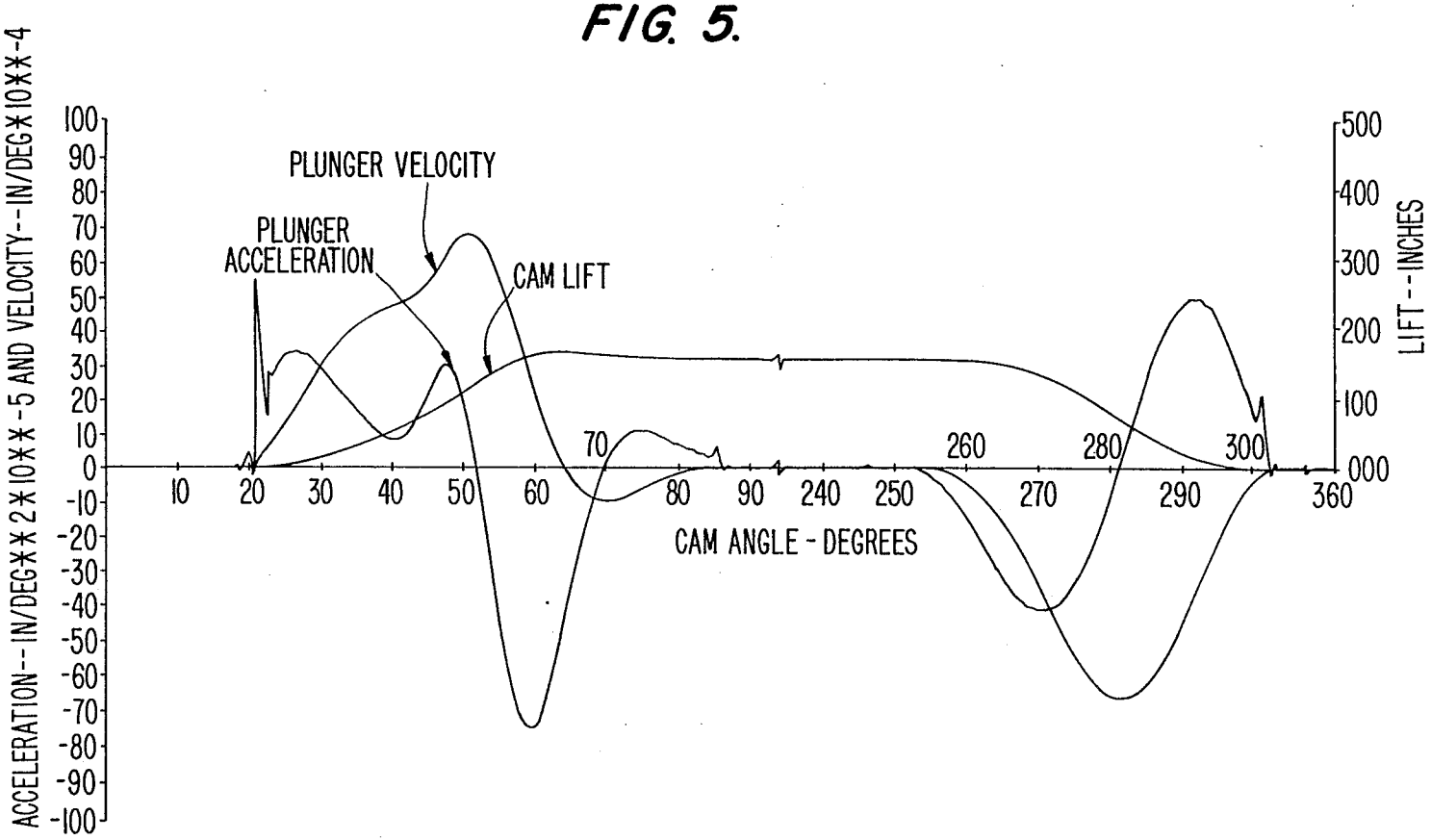
FIG. 5 is a graph illustrating the characteristics of the cam of FIGS. 1 and 2.

FIG. 5 is a detailed graph of the cam lift, the cam induced plunger velocity, and the cam induced plunger acceleration versus the cam degrees of rotation for the entire 360° surface of the cam. The cam lift curve has been explained with reference to FIG. 3 and the cam induced plunger velocity curve has been detailed using FIG. 4.

Figure 6:
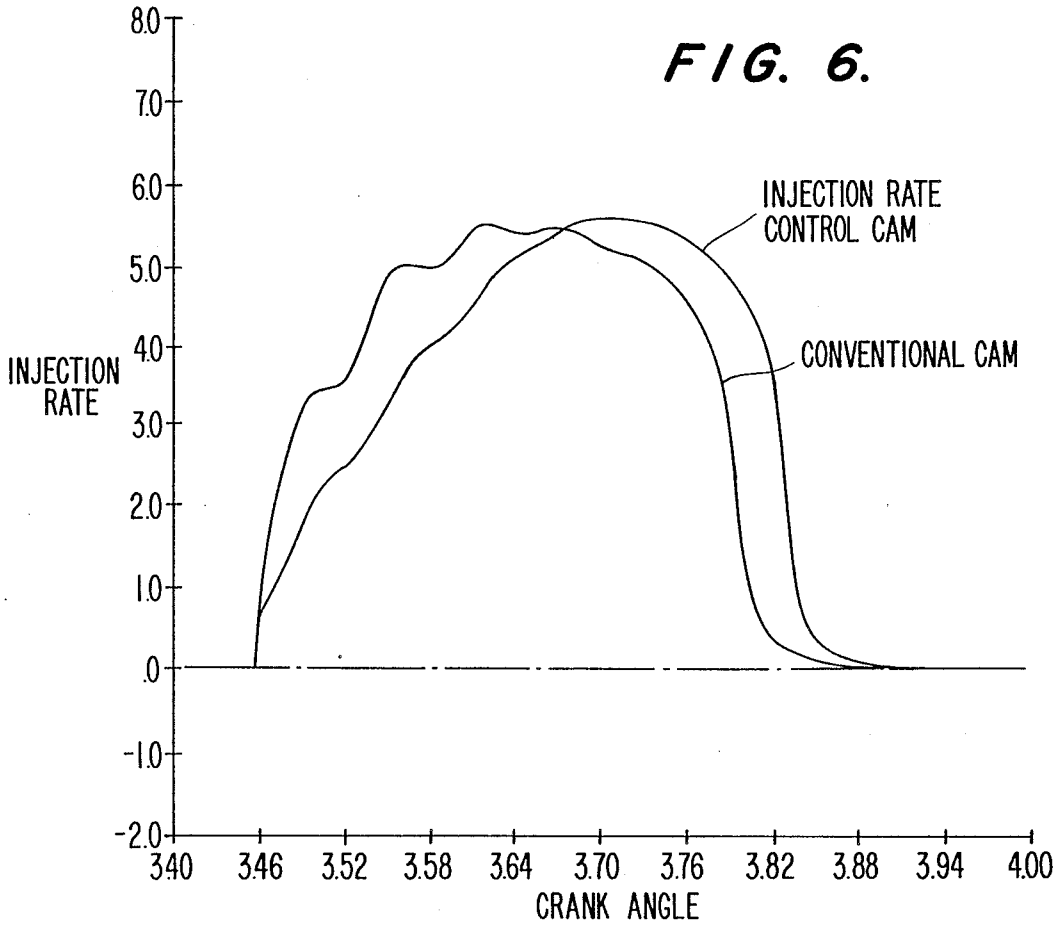
FIG. 6 is a graph comparing the injection rate of the cam of FIGS. 1 and 2 with that of a conventional cam.

FIG. 6 compares the injection rates for the injection rate control cam 12 of the present invention with a conventional cam by plotting the injection rate vs. the crank angle. As illustrated, the cam of the present invention achieves the objectives of the present invention and has a lower injection rate at the beginning of injection in addition to advancing the injection timing and providing a smoother initial injection rate. Additionally, as illustrated in FIG. 6, the end of injection is sharper using the injection rate control cam according to the present invention. By controlling injection to provide a lower rate of injection at the beginning of injection, cam 12 of the present invention controls the amount of premixed fuel burning. Additionally, the cam profile provides better control over the rate of fuel injection to reduce engine noise, nitric oxide emissions, and the amount of unburned hydrocarbons.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

Industrial Applicability

The injection rate control cam of the present invention finds application in a large variety of internal combustion engines. One particularly important application is for small compression ignition engines such as those for automotive vehicles as well as stationary power plants. The injection rate control cam can vastly improve combustion performance over conventional cams in these applications. Emissions requirements may be met without using variable injection timing.

What is claimed is:

1. A cam for controlling the injection rate of fuel in a fuel injection system of an engine, the fuel injection system including a cyclically operating unit injector having a body, an injector plunger mounted for reciprocating movement in the injector body between an advanced position and a retracted position to inject into the engine during each cycle a variable quantity of fuel up to a maximum quantity under rated engine conditions, and a drive train for converting rotational movement of said cam into reciprocating movement of the pumping plunger depending on the profile of said cam, wherein said cam profile comprises at least a plunger retraction segment and a plunger advancement segment for controlling the velocity of injector plunger retraction and advancement, respectively, said plunger advancement segment including a pre-injection subsegment shaped to cause the injector plunger velocity to be relatively low thereby to cause no more than 10 percent of the maximum quantity of fuel to be injected into the engine during each cycle at rated engine conditions while said pre-injection subsegment is in contact with the drive train, said pre-injection subsegment including at least approximately 25 percent of the arcuate length of said plunger advancement segment of said cam profile.

2. A cam according to claim 1, wherein said pre-injection subsegment is shaped to cause a relatively low average flow rate of no more than approximately 5 percent of the maximum quantity of fuel to be injected into the engine during each cycle at rated engine conditions while said pre-injection subsegment is in contact with the injector drive train.

3. A cam according to claim 1, wherein said advancement segment includes an injection subsegment following said pre-injection subsegment, said injection subsegment being shaped to cause injection of substantially all of the remaining portion of the fuel to be injected during each cycle at the maximum possible flow rate without exceeding the stress limits of said cam.

4. A cam according to claim 3, wherein the ratio of the average flow rate caused by said injection subsegment and the average flow rate caused by said pre-injection subsegment is at least 2.5.

5. A cam according to claim 4, wherein said ratio ranges from 2.5 to 7.

6. A cam according to claim 4, wherein the average fuel flow rate caused by said pre-injection subsegment ranges from 0.5 to 1 cubic millimeter per cam angle degree of rotation and the average fuel flow rate caused by said injection subsegment ranges from 2.5 to 3.5 cubic millimeters per cam angle degree of rotation.

7. A cam according to claim 3, wherein the stress limits reached by said injection subsegment are between 240,000 and 250,000 pounds per square inch.

8. A cam according to claim 3, wherein said injection subsegment includes at least approximately 33 percent of the arcuate length of said advancement segment of said cam profile.

9. A cam according to claim 8, wherein said injection subsegment is shaped to cause the velocity of said injector plunger to increase during a initial portion of said injection subsegment and to decrease during a final portion of said injection subsegment such that the highest injector plunger velocities are achieved intermediate the initial and final portions of said injection subsegment.

10. A cam according to claim 9, for use with an injector body having a nozzle at one end through which fuel is supplied to the engine from the injector by advancement of the injector plunger and having a plunger stop adjacent the nozzle for arresting advancement of the injector plunger by engaging the advancing tip of the injector plunger, wherein said advancement segment of said cam includes an overtravel subsegment shaped to cause the advancing tip of the injector plunger to be advanced into engagement with the plunger stop to close the injector nozzle and to hold the plunger tip in engagement with the plunger stop by continuing to advance the injector plunger to cause elastic deformation of the injector body adjacent the injector nozzle.

11. A cam according to claim 10, wherein said overtravel subsegment includes at least approximately 29 percent of the arcuate length of said advancement segment of said cam profile.

12. A cam according to claim 1 wherein said cam profile includes a retracted dwell segment following said retraction segment to hold the injector plunger in its retracted position and an advanced dwell segment following said advancement segment to hold the injector plunger in its advanced position.

13. A cam according to claim 3, wherein said cam causes injection of less than 20 cubic millimeters of fuel during the 10 cam angle degrees of rotation of said cam following initial engagement of said pre-injection subsegment of said advancement segment of said cam profile with the drive train.

14. A cam for controlling the injection rate of fuel in a fuel injection system of an engine, the fuel injection system including a cyclically operating unit injector having a body, an injector plunger mounted for reciprocating movement in the injector body between an advanced position and a retracted portion to pump into the engine during each cycle a variable quantity of fuel up to a maximum quantity under rated engine conditions, and a drive train for converting rotational movement of said cam into reciprocating movement of the pumping plunger depending on the profile of said cam, wherein said cam profile comprises at least a plunger retraction segment and a plunger advancement segment for controlling the velocity of injector plunger retraction and advancement, respectively, said plunger advancement segment including a pre-injection subsequent shaped to cause an initial quantity of fuel to be injected into the engine during each cycle at rated engine conditions while said pre-injection subsegment is in contact with the drive train, and an injection subsegment following said pre-injection subsegment, said injection subsegment being shaped to cause injection of substantially all of the remaining portion of the fuel to be injected during each cycle at the maximum possible flow rate without exceeding the stress limits of said cam, wherein said injection subsegment is shaped to cause the velocity of said injector plunger to increase during an initial portion of said injection subsegment and to decrease during a final portion such that the highest injector plunger velocities are achieved before the midpoint of the injection subsegment.

15. A cam for controlling the injection rate of fuel in a fuel injection system of an engine, the fuel injection system including a cyclically operating unit injector having a body, an injector plunger mounted for reciprocating movement in the injector body between an advanced position and a retracted position to pump into the engine during each cycle a variable quantity of fuel up to a maximum quantity under rated engine conditions, and a drive train for converting rotational movement of said cam into reciprocating movement of the pumping plunger depending on the profile of said cam, wherein said cam profile comprises at least a plunger retraction segment and a plunger advancement segment for controlling the velocity of injector plunger retraction and advancement, respectively, said plunger advancement segment including a pre-injection subsequent shaped to cause an initial quantity of fuel to be injected into the engine during each cycle at rated engine conditions while said pre-injection subsegment is in contact with the drive train, and an injection subsegment following said pre-injection subsegment, said injection subsegment being shaped to cause injection of substantially all of the remaining portion of the fuel to be injected during each cycle at the maximum possible flow rate without exceeding the stress limits of said cam, wherein said injection subsegment is shaped to cause the velocity of said injector plunger to increase during an initial portion of said injection subsegment and to decrease during a final portion such that the highest injector plunger velocities are achieved intermediate the initial and final portions of said injection subsegment, wherein the ratio of the average flow rate caused by said injection subsegment and the average flow rate caused by said pre-injection subsegment is at least 2.5, and wherein the average fuel flow rate caused by said pre-injection subsegment ranges from 0.5 to 1 cubic millimeter per cam angle degree rotation and the average fuel flow rate caused by said injection subsegment ranges from 2.5 to 3.5 cubic millimeters per can angle degree of rotation.

16. A cam according to claim 15, wherein said ratio ranges from 2.5 to 7.

17. A cam according to claim 14, wherein the stress limits reached by said injection subsegment are between 240,000 and 250,000 pounds per square inch.

18. A cam according to claim 14, wherein said injection subsegment includes at least approximately 33 percent of the arcuate length of said advancement segment of said cam profile.

19. A cam according to claim 14, wherein during said injection subsegment the cam induced plunger acceleration is maximized.

20. A cam for controlling the injection rate of fuel in a fuel injection system, in which the fuel injection system includes a cyclically operating unit injector having a body, an injector plunger mounted for reciprocating movement in the body between an advanced position and a retracted position to pump a variable quantity of fuel into the engine during each cycle, and a drive train for converting rotational movement of said cam into reciprocating movement of the injector plunger, wherein the cam profile includes a plunger advancement segment and a plunger retraction segment, said plunger advancement segment including:

a pre-injection subsegment having a profile to cause an initial quantity of fuel to be injected into the engine, said pre-injection segment including at least approximately 25% of the arcuate length of plunger advancement segment;

an injection subsegment having a profile which causes the velocity of said injector plunger to increase during an initial portion of said injection subsegment and to decrease during a final portion of said injection subsegment, wherein the average flow rate during the injection subsegment is at least twice the average flow rate during the pre-injection subsegment; and an overtravel subsegment having a profile which causes an advancing tip of the injector plunger to be advanced into engagement with a plunger stop to close the injector nozzle and to hold the plunger tip in engagement with the plunger stop by continuing to advance the plunger to cause elastic formation of the injector body adjacent the injector nozzle, wherein said overtravel subsegment comprises at least 25% of the arcuate length of the plunger advancement segment.

21. The cam of claim 20, wherein the plunger advancement segment comprises approximately 120° of the cam profile, said cam further including an advanced dwell segment comprising approximately 80° of the cam profile, a plunger retraction segment comprising approximately 100° of the cam profile, and a retracted dwell segment comprising approximately 60° of the cam profile.

22. The came of claim 20, wherein said injection subsegment comprises at least 35% of the plunger advancement segment.

23. The cam of claim 20, wherein the pre-injection subsegment comprises approximately 25–35% of the plunger advancement segment, the injection subsegment comprises approximately 37–41% of the plunger advancement segment, and the overtravel subsegment comprises approximately 29–33% of the plunger advancement segment.

* * * * *